US006035544A

United States Patent [19]

Morrison et al.

[11] Patent Number: 6,035,544

[45] Date of Patent: Mar. 14, 2000

[54] GRAIN TURNER FOR TOWER GRAIN DRYER AND METHOD

[75] Inventors: David Wayne Morrison, County of Macoupin; John Michael Frankovich, County of Macon, both of Ill.

[73] Assignee: The GSI Group, Inc., Assumption, Ill.

[21] Appl. No.: 09/224,226

[22] Filed: Dec. 30, 1998

[51] Int. Cl.[7] ..... F23H 17/12

[52] U.S. Cl. ..... 34/167; 34/174; 34/175

[58] Field of Search ..... 34/167, 174, 178, 34/169, 586, 233, 64, 65, 86, 170, 175; 432/17, 97, 198, 101

[56] References Cited

U.S. PATENT DOCUMENTS

| | | | |
|---|---|---|---|
| 3,751,824 | 8/1973 | Kyle | 34/174 |
| 4,149,844 | 4/1979 | Noyes | 34/174 |
| 4,250,632 | 2/1981 | Botkins et al. | 34/174 |
| 4,308,669 | 1/1982 | Noyes et al. | 34/174 |
| 5,566,470 | 10/1996 | Morrison . | |
| 5,651,193 | 7/1997 | Rhodes et al. . | |

*Primary Examiner*—James C. Yeung
*Attorney, Agent, or Firm*—Polster, Lieder, Woodruff & Lucchesi

[57] ABSTRACT

A grain turner (101)of the present invention is adapted for use with a grain dryer having an inner dryer wall (7) and an outer dryer wall (9) spaced therefrom and defining a vertically extending grain path (11) therebetween. A grain turner (101) of the present invention is disposed within the grain path for exchanging (turning) grain from the inner portion of the grain path to the outer portion of the grain path and vice versa and for exchanging grain widthwise within the grain path. The grain turner comprises a vertical wall (109) disposed between the inner and outer dryer walls. The grain turner further has at least one pair inclined plates (119, 125) with one of the plates (119) being on the inside of the vertical wall and with the other of the inclined plates (125) being on the outside of the vertical wall. Plate (119) is inclined downwardly in a first widthwise direction and the other of the inclined plates is inclined downwardly in the opposite widthwise direction. The lower end of the first inclined plate (119) extends downwardly and outwardly so as to deliver grain flowing downwardly thereon to a location within the grain path substantially beneath the second inclined plate (125). The lower end of inclined plate (125) extends downwardly and inwardly so as to deliver grain to a location within the grain path substantially beneath the first inclined plate. In this manner, the grain flowing down the first inclined plate is turned from the inside to the outside of the grain path and the grain flowing down the second inclined plate is turned from the outside to the inside of the grain path. Further, the grain flowing down the inclined plates is rotated about a substantially vertical axis within the grain path so as to effect the widthwise exchange of grain from one width location to another as the grain is turned.

A method of turning grain is also disclosed.

12 Claims, 7 Drawing Sheets

GRAIN TURNER FOR TOWER GRAIN DRYER AND METHOD

CROSS-REFERENCE TO RELATED APPLICATIONS

NONE

STATEMENT REGARDING FEDERALLY SPONSORED RESEARCH OR DEVELOPMENT

Not applicable.

BACKGROUND OF THE INVENTION

This invention relates to grain turner for a grain dryer or the like, and more particularly to such a grain turner which turns the grain from the inside to the outside and vice versa of a vertical grain path as the column moves downwardly within the dryer in such manner that dried grain is substantially dried in all regions of the grain path.

Tower grain dryers are well known. Generally, they comprise a vertical tower of cylindrical or other shape. The tower has a plenum located within the tower. The outer wall of the plenum is perforated and is generally a vertical cylindrical wall. This outer plenum wall has another cylindrical wall spaced outwardly therefrom a distance of about 12 inches (30.48 cm.) so as to form a vertical grain path between the two walls with the cross section of the grain path being an annulus approximately 12 inches thick. As noted, the walls of the grain path are of porous construction such that heated air from within the plenum may be forced through the walls and through the grain in the grain path. Grain to be dried is conveyed to the upper reaches of the tower and fills the space between the outer dryer wall and the plenum so as to form a drying path for the grain to be dried. As dried grain is continuously discharged from the lower end of the grain drying path, additional grain to be dried is loaded into the upper end of the drying path.

The plenum is supplied with heated air by means of one or more burner/blower assemblies. The heated air is forced from within the plenum through the porous or perforated walls of the plenum, through the grain in the drying path, and is forced through the porous outer wall of the tower carrying away moisture from the grain.

Reference may be made to the following U.S. Patents which describe tower or other similar types of grain dryers of the type discussed above: U.S. Pat. Nos. 746,410, 3,333,348, 3,710,449, 3,766,664, 3,864,845, 3,896,562, 3,955,288, 4,004,351, 4,398,356, 4,423,557, 4,914,834, 5,129,164, 5,136,791, 5,556,470, AND 5,651,193.

Conventionally, many of the tower grain dryers and continuous flow portable dryers now used commercially are so-called cross flow column dryers. That is, as the vertical, annular column of grain is metered downwardly, heated air is force outwardly from the plenum through the grain path. Thus, the grain proximate the inner wall of the grain path oftentimes becomes over dried and the grain on the exterior of the grain path is under dried. In order to overcome this uneven drying problem, such tower dryers are often provided with a variety of grain turning device which were intended to reduce the moisture gradient in the grain path by mixing the grain within the grain path once or twice as the grain moves downwardly within the column.

One type of prior art grain turner is known as a grain exchanger. Such grain exchangers splits the grain path in half and channels the grain on the inner reaches of the grain path to the outside of the grain path and channels the grain on the inner portion of the grain path toward the outside of the grain path. One such prior art grain exchanger manufacture by the assignee of the present invention is shown in FIGS. 2 and 3, and is more particularly described hereinafter.

Even though these prior art grain exchangers did succeed in reducing the moisture gradient of the grain path, it was found that instead of moving the grain on the inside of the grain path which received the maximum heating is only channeled part way toward the exterior of the grain path and the grain proximate the outside of the grain path is not fully moved to the inner wall. Thus, such prior art grain turners were not as efficient in turning the grain was would have been desired. Further with such prior art grain turners, were known to waste a considerable amount of energy in drying the grain because of the inefficient mixing of the grain from different regions of the grain paths. Specifically, with the warmest grain on the innermost regions of the grain path nearest the plenum, air movement of the heated air from the plenum took heat from the warmest grain and forced it from the grain path and exhausted it to the atmosphere.

There has been a need for a grain turner which more efficiently turns the grain and, more specifically, which moves the grain widthwise within the grain path as it is turned from the inside to the outside and vice a versa.

BRIEF SUMMARY OF THE INVENTION

Among the several objects of the present invention may be noted the provision of a grain turner in which the grain path may be divided and rotated 180° (i.e., substantially twisted about a vertical axis) so that the grain on the outside of the grain path is exchanged with the grain on the inside of the grain path (and vice versa) and so the grain is exchanged in widthwise direction from one vertical channel within the grain path to another;

The provision of such a grain turner which may, if desired, leave a layer of relatively moist grain on the exterior of the grain path of predetermined thickness (e.g., 2 inches) by allowing such layer of grain to bypass the grain turner as such grain moves downwardly within the grain path such that this layer remains substantially undisturbed proximate the outer wall of the dryer so as to prevent the discharge of fines and other solid debris from the grain as the grain in the grain path flows through and is turned by the grain turner of the present invention;

The provision of such a grain turner which results in cleaner operation of the tower dryer because less fines and other material from the drying grain are discharged to the atmosphere;

The provision of such a grain turner which may be used with both tower dryers and with portable continuous flow grain dryers;

The provision of such a grain turner which has no moving parts and requires no motor or other power source, but instead operates upon the downward movement of the grain path; and The provision of such a grain turner which is of rugged and economic construction, which is reliable in operation, and which more thoroughly mixes the grain within the grain path.

Briefly stated, a grain turner of the present invention may be used with either a tower grain dryer or with a portable continuous flow dryer. Such dryers have an inner dryer wall and an outer dryer wall spaced therefrom and defining a vertically extending grain path therebetween. Preferably, the inner and outer dryer walls are porous to allow drying air to pass therethrough. These dryer walls define a generally vertically extending grain path having a thickness corresponding generally to the space between the inner and outer dryer walls. The grain path further has a height direction extending vertically of the grain path and a width direction extending generally horizontally within the space between the inner and outer dryer walls. The grain turner of the present invention is disposed within the grain path between the inner and outer dryer walls for exchanging (turning) grain from the inner portion of the grain path to the outer portion of the grain path and vice versa and for exchanging grain widthwise within the grain path. The grain turner comprises a vertical wall disposed between the inner and outer dryer walls. This vertical wall is generally parallel to the inner and outer dryer walls. The grain turner further has at least one pair inclined plates with one of the plates being on the inside of the vertical wall and with the other of the inclined plates being on the outside of the vertical wall. The one of the inclined plates is inclined downwardly in a first widthwise direction and the other of the inclined plates is inclined downwardly in the opposite widthwise direction. The lower end of the first inclined plate extends downwardly and outwardly so as to deliver grain flowing down the upper surface of the first inclined plate to a location within the grain path substantially beneath the second inclined plate. The lower end of the second inclined plate extends downwardly and inwardly so as to deliver grain flowing down the upper surface of the second inclined plate to a location within the grain path substantially beneath the first inclined plate. In this manner, the grain flowing down the first inclined plate is turned from the inside to the outside of the grain path and the grain flowing down the second inclined plate is turned from the outside to the inside of the grain path. Further, the grain flowing down the inclined plates is rotated about a substantially vertical axis within the grain path so as to effect the widthwise exchange of grain from one width location to another as the grain is turned.

Other objects and features of this invention will be in part apparent and in part pointed out hereinafter.

BRIEF DESCRIPTION OF THE SEVERAL VIEWS OF THE DRAWINGS

Corresponding reference characters represent corresponding parts throughout the various views of the drawings.

DETAILED DESCRIPTION OF THE INVENTION

Figure 1:
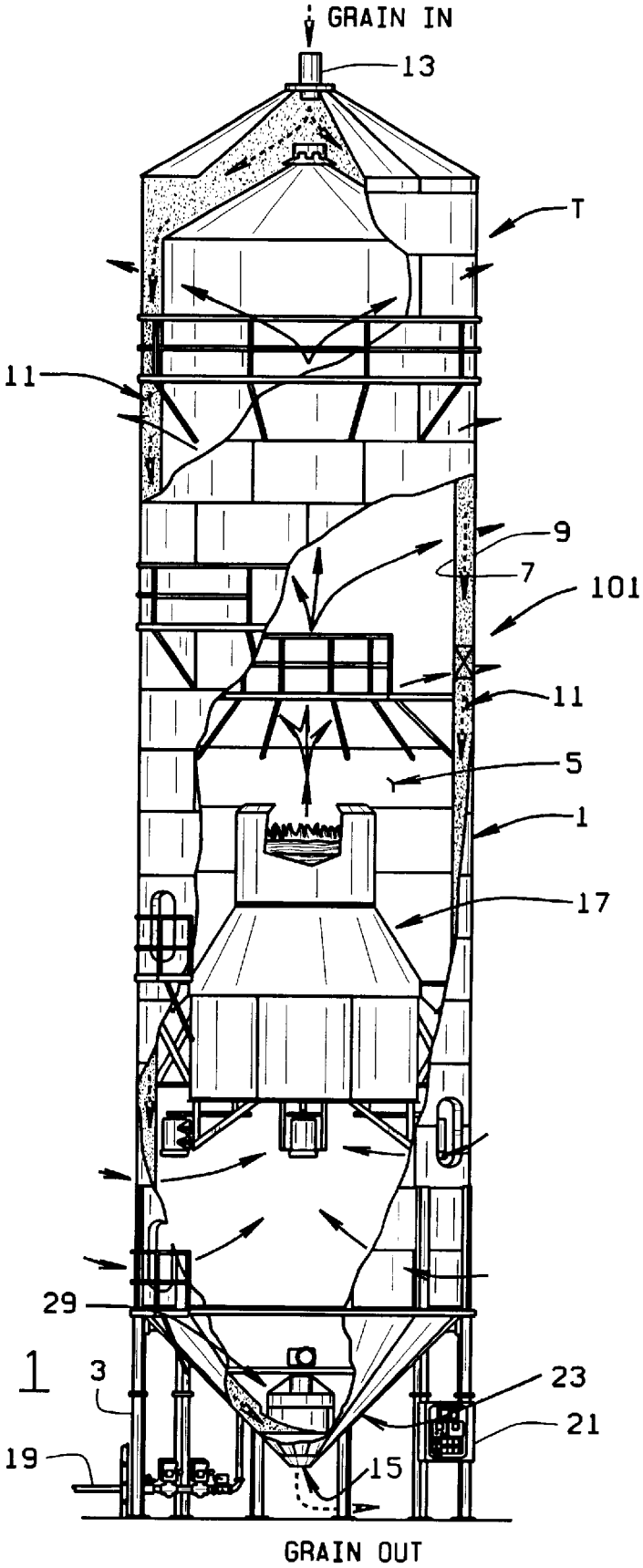
FIG. 1 is an elevational view (with portions broken away) of a tower grain dryer having a grain turner of the present invention installed in the grain path of the dryer.

Referring now to the drawings, and more particularly to FIG. 1, a cylindrical tower dryer T is shown in partial cross section. More specifically, tower dryer T comprises a vertical grain drying tower 1 which may, for example, be fifty (50) feet (15+ m.) or more in height. The tower has a base 3 of suitable structural steel members mounted in a suitable foundation (not shown). A plenum 5 is disposed within the grain dryer. The plenum 5 is defined by a generally cylindrical porous plenum wall 7, which wall is also referred to as an inner wall. Tower 1 has an outer cylindrical dryer wall 9 of porous (perforate) construction surrounding plenum wall 7 and spaced outwardly therefrom so as to define a vertical, annular grain drying path 11 (sometimes referred to as a grain column). While the spacing between porous walls 7 and 9 may vary, typically the spacing between these walls is approximately 12 inches (30.98 cm.). Grain may be supplied to grain drying path 11 by means of a grain inlet 13 at the top of tower 1 and dried grain may be discharged from the tower dryer by means of a grain discharge outlet 15 at the lower end of the dryer.

As generally indicated at 17, a heater/blower assembly is provided within the grain dryer for drawing ambient air through the grain path 11 in the lower reaches of the tower and, if demanded, for heating the air, and for discharging the heated air under pressure into plenum 5. In this manner, the air discharged from heater/blower 17 is distributed substantially uniformly within the plenum and is forced to flow through the porous plenum wall 7, through the grain in grain drying path 11, and is exhausted through the porous outer wall tower 9 to the atmosphere thereby drying the grain in the grain path and carrying moisture from the grain to the atmosphere. While heater/blower 17 is shown in FIG. 1 to be located within tower 1, it will be understood that within the broader aspects of this invention that the heater/blower may be located outside the tower in close proximity thereto and air from the heater/blower may be ducted into plenum 5. Typically, fuel for heater/blower assembly 17 is supplied by gas fuel supply lines 19 and operation of the heater/blower assembly and overall operation of tower dryer T is controlled by a computer control housed in a control panel 21.

As shown in FIG. 1, tower 1 has a converging conical hopper bottom 23. The grain path 11 may be divided into a plurality of vertical grain channels GC by vertically extending pairs of channels 25*a*, 25*b* having one flange 27 secured to the inner wall 7 and another flange 29 secured to outer dryer wall 9. For example, depending on the diameter of the tower dryer 1, the grain path may be divided into about 12–20 of such grain channels GC.

As generally indicated at 101 in FIG. 1, a grain turner of the present invention is provided at one or more locations along the vertical grain path 11 for turning some or all of the grain in the grain path such that the grain on the inner reaches of the grain path is exchanged with grain from the outer reaches of the grain path and so that grain is exchanged widthwise in the grain path and so that grain in the grain path is twisted approximately 180° about a vertical axis so as to intermix dry grain from the inner portion of the grain path with less dry grain from the outer regions of the grain path. In this manner, dried grain proximate the inner wall 7 is moved outwardly and cooler, wetter grain from the outer regions of the grain path is moved closer to the inner wall. In addition, with the grain turner of the present invention, grain is exchange in widthwise (circumferential) direction within the grain path such that if the grain flowing downwardly in the grain path dries uneven with respect to grain in nearby widthwise location within the grain path, the widthwise exchange of grain effected so as to redistribute the grain within the grain path. This prevents the grain from being over dried and consequently damaged by possible overheating and it insures that the grain proximate the outer wall is sufficiently dried. Further in accordance with this invention, grain from different regions of the grain path is exchanged with grain on either side thereof so as to better intermix the grain in the event the grain from different radial regions flows downwardly in the grain path at different speeds and thus is subjected to different amounts of drying.

Figure 2:
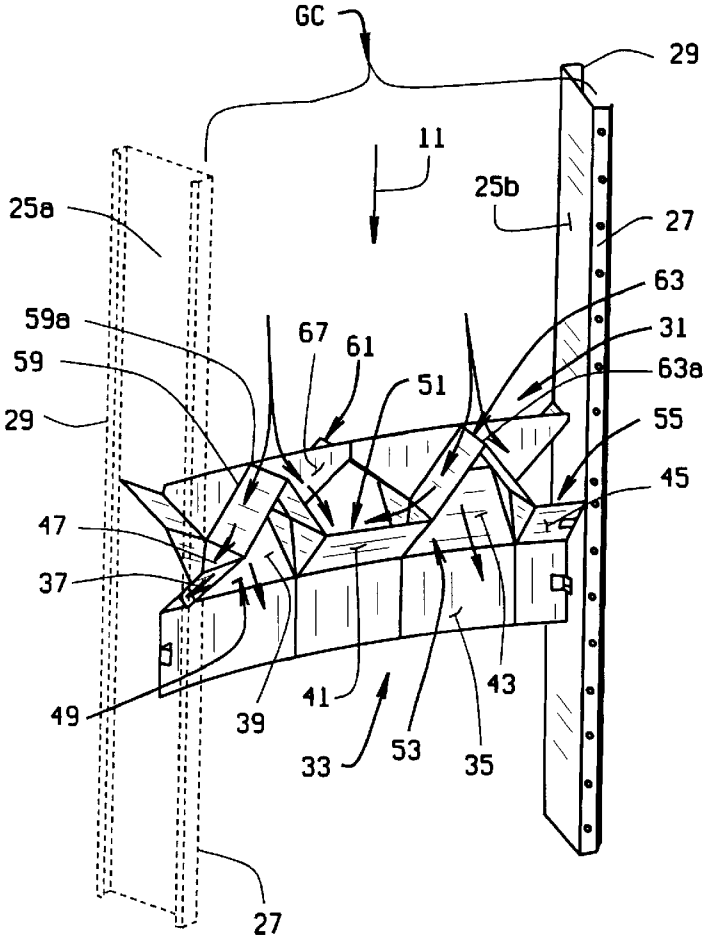
FIG. 2 PRIOR ART
FIG. 2 is a perspective view of a vertical channel comprising a portion of the grain path having a section of a prior art grain turner installed within the grain channel.

Referring now to FIG. 2, a prior art grain turner is shown. This prior art grain turner is indicated generally at 31. This prior art grain turner may be installed in the grain path 11 of tower dryer T in the location shown in FIG. 1 for the grain turner 101 of the present invention. Specifically, prior art grain turner 31 includes a plurality of grain turner sections 33, one for each of the vertical grain channels GC within the tower dryer. Each grain turner section 33 comprises a lower vertical plate 35 disposed within the grain path 11 between inner wall 7 and outer wall 9 of tower dryer 1. Lower vertical wall 35 has a series of sloped sheets 37–45 bent from and extending in alternating inclined directions from the upper end of vertical plate 35. Slope sheets (also referred to as inclined plates) 37, 41, and 45 extend upwardly and inwardly toward inner dryer wall 7 from the upper edge of vertical 35. Inclined plates 39 and 43 alternate with inclined plates 37, 41 and 45 and extend upwardly and outwardly toward outer dryer wall 9 from the upper edge of vertical wall 35. Inclined plates 37, 41 and 45 form the bases of respective inclined chutes 47, 51, and 55 which also are inclined upwardly and inwardly toward inner dryer wall 7 from the upper edge of vertical wall 35. Likewise, inclined plates 39 and 43 define the bases of inclined chutes 49 and 53 which extend upwardly and outwardly from the upper edge of the vertical plate toward outer dryer wall 9.

Above each of the chutes 47, 49, 51, 53 and 55 are respective peak assemblies as generally indicated at 57, 59, 61, 63 and 65, respectively. Each peak assembly 59, 61 and 63 has a respective apex 59*a*, 61*a*, 63*a* and downwardly sloping side sheets 59*b*–59*c*, 61*b*–61*c*, 63*b*–63*c*. Each of these peak side sheets has a generally vertically disposed tail 59*d*–59*e*, 61*d*–61*e*, 63*d*–63*e* which form the side walls of chutes 49, 51 and 53. As indicated at 67, grain turner section 33 further has an upper vertical wall having a plurality of cutouts 67, 69, 71 therein thus allowing chutes 49, 51 and 53 to pass from one side of vertical wall 67 to the other.

Figure 3:
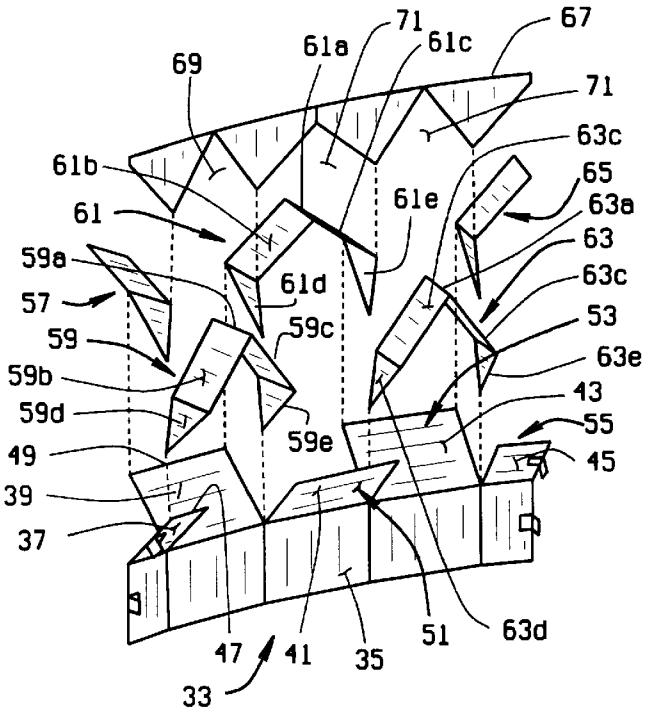
FIG. 3 PRIOR ART
FIG. 3 is an exploded view of the prior art grain turner illustrated in FIG. 2.

As best seen in FIGS. 2 and 3, inclined plates 37 and 45 are only about half the horizontal length of inclined plates 39, 41 or 43 and thus channels 47 and 55 are about half the width of channels 49, 51 and 53. Above each of the outer channels 47 and 55 have partial peak assemblies 73 and 75 having only one peak side 77 and 79, respectively, with the upper end of each peak side abutting the web of a respective channel 25*a*, 25*b* so as to direct grain flowing downwardly proximate the channels in widthwise direction away from the channels 25*a*, 25*b* thereby to aid in the intermixing of the grain and to insure that grain proximate the channels is sufficiently dried as it moves down the grain path. Grain turner section 33 is secured to channels 25*a*, 25*b* by means of clips 73.

In operation, grain flows downwardly by gravity within grain path 11 of tower dryer T and as it encounters the prior art grain turner 21, the inner half of the grain column is divided into an outer and an inner portion by vertical wall 67 and the inner and outer portions of the grain column encounters respective inner and outer peaks 59–63. For example, the grain encountering peak 59 is split by the two inclined plates 59*b*, 59*c* and is directed into respective chutes 37 and 41 which in turn divert the grain from the inner column to the outer column. However, it will be noted that this prior art grain turner merely transfers the grain between the inner and outer portions of the grain column and does effectively guarantee that the grain from adjacent vertical flowpaths is intermixed in widthwise direction. Further, as shown in FIG. 7, this prior art grain turner does not rotate or twist vertical columns of grain with one another about a vertical axis, as does the grain turner 101 of the present invention.

Figure 4:
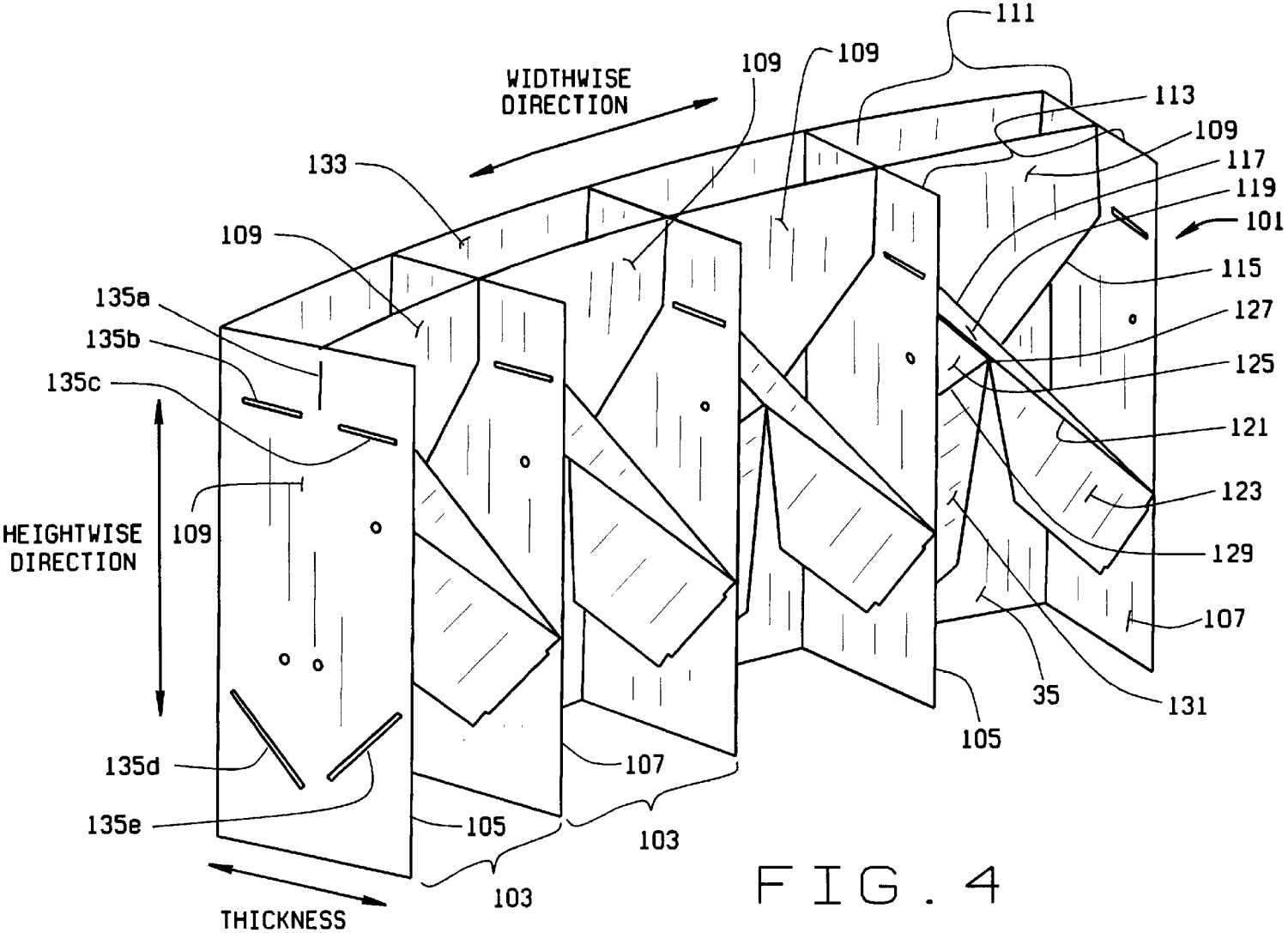
FIG. 4 is a perspective view of a section of the grain turner of the present invention, with FIG. 4 illustrating four turning modules arranged in side-by-side relation so as to be readily installed within the grain path of a grain dryer.
Figure 5:
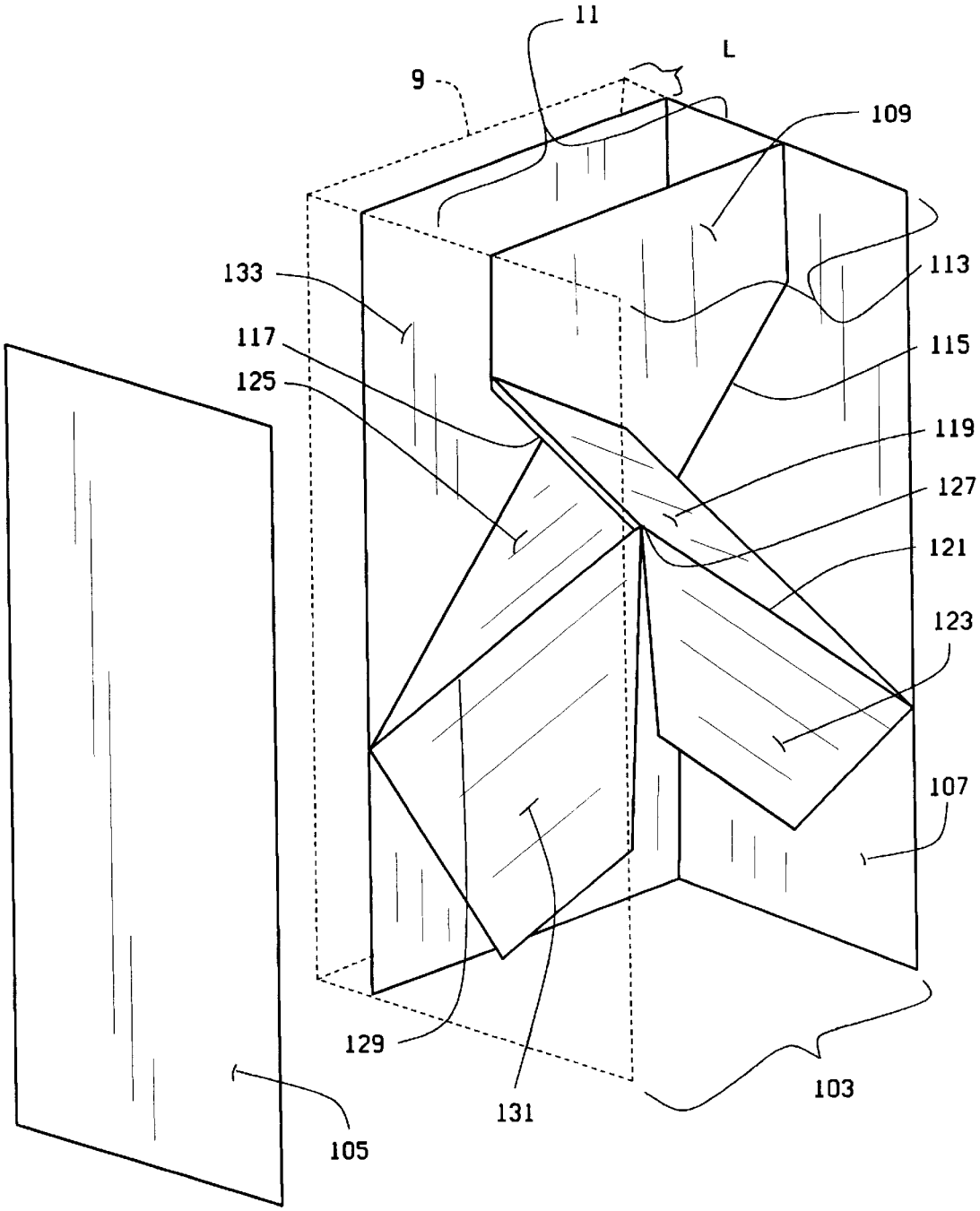
FIG. 5 is a perspective view of a single module of the grain turner of the present invention with portions of the module shown in phantom so as to better illustrate the shape and function of the various components of the turning modules.
Figure 6:
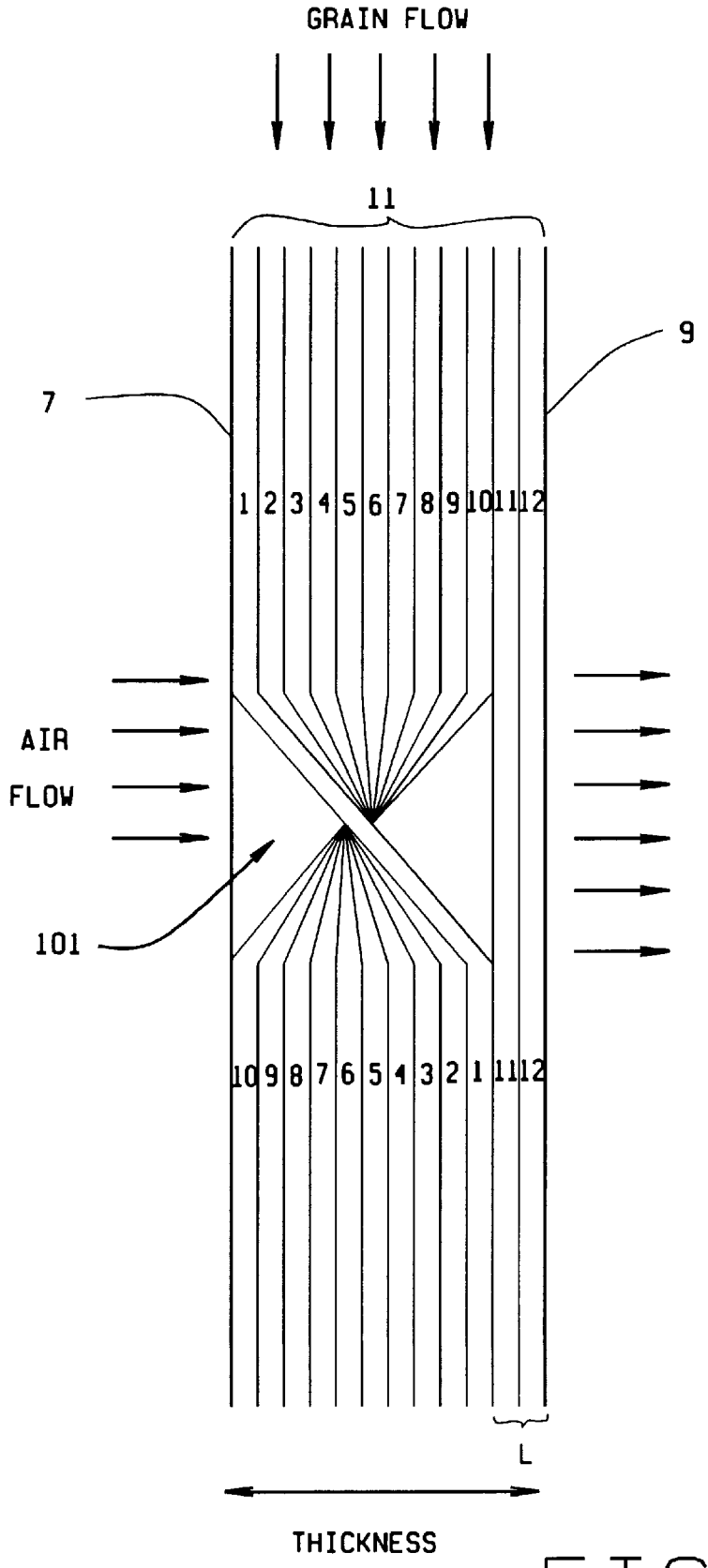
FIG. 6 is a diagrammatic view of a cross section of the grain path illustrating how the grain turner of the present invention exchanges grain from the inner wall of the grain path with grain from the outer region of the grain path and turns or twists grain flowing in one vertical column in widthwise direction with grain flowing downwardly in another vertical column while allowing grain proximate the outer wall to by pass the grain turner of the present invention.
Figure 7:
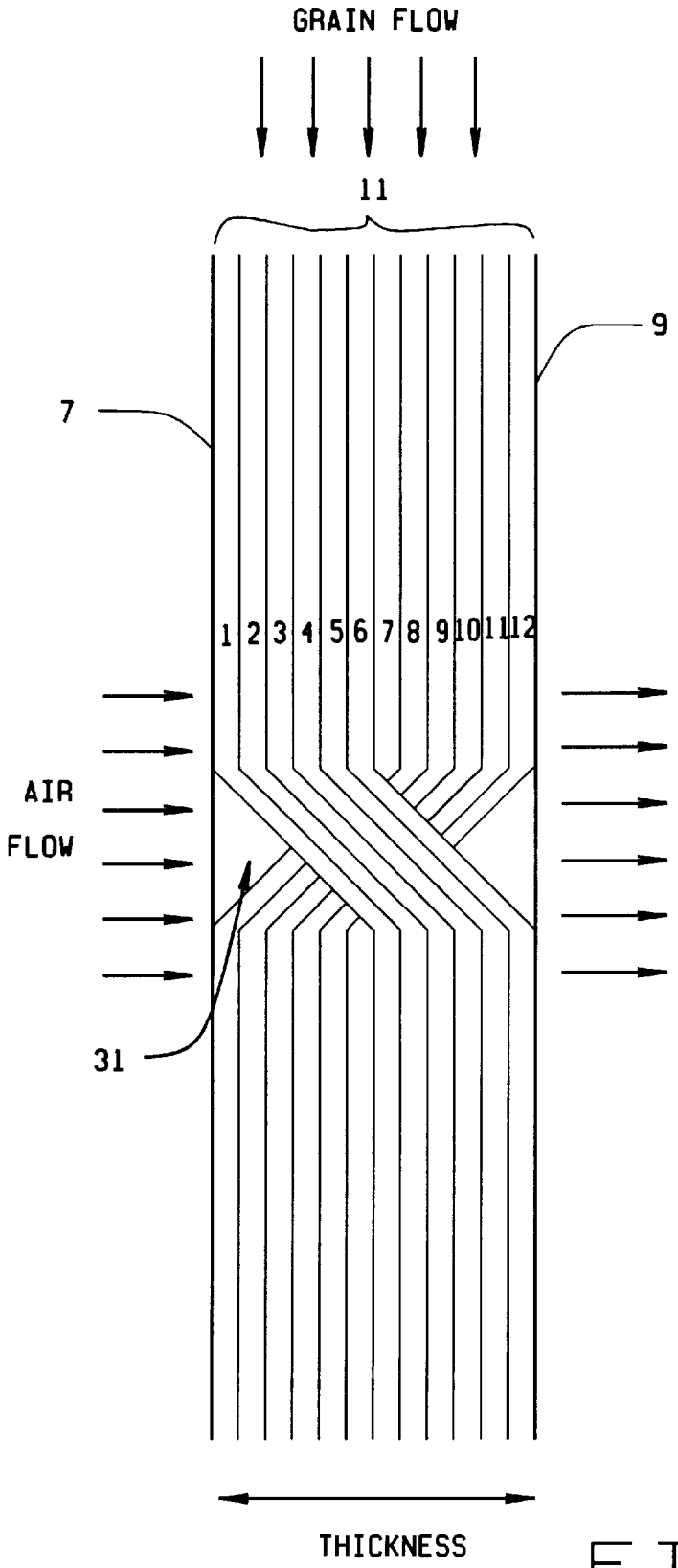
FIG. 7 PRIOR ART
FIG. 7 is a diagrammatic view of a cross section of the grain path illustrating how a prior art grain turner exchanges grain.

Referring now to FIGS. 4 and 5, the grain turner 101 of the present invention will be described in detail and it will be pointed out how it differs structurally and operationally from prior art grain turner 31, as illustrated in FIGS. 2, 3 and 7. Grain turner 101 is shown to be comprised of a plurality of turning modules, as indicated generally at 103. The section of grain turner 101 illustrated in FIG. 4 is shown to have four such turning modules 103. It will be appreciated that, depending on the diameter of the tower dryer, a multiplicity of such turner modules may be needed so that the grain turner 101 will extend substantially continuously around the dryer at the location shown in FIG. 1. Each module 103 comprises a pair of vertical side plates 105, 107, with each of the interior vertical side plates serving two adjacent modules. As shown in FIG. 4, the side plates extend into the grain column from the inner wall 7 toward the outer wall 9 of the dryer. The height of grain turner 101 may vary, depending on the size of the dryer in which it is installed. However, for a tower dryer as shown in FIG. 1, the height of the turner modules 103 may be about 2 feet (61 cm.). Between each of the side plates 105, 107, a vertical wall 109 is provided approximately midway between the inner and outer portions of the module thus dividing the module into an outer channel 111 and an inner channel 113. Each vertical plate 109 has downwardly sloped lower edges 115 and 117 which are generally within the vertical plane of vertical plate 109. Further, inner channel 113 of each module 103 has a respective inclined plate 119 secured (preferably welded) to its respective side plates 105, 107 at an angle comparable to the angle of the downwardly sloping edge 115 of vertical plate 109. The lower end of inclined plate 119 has an oblique bend line 121 (i.e., a bend line that extends across the width of plate 119 at an angle) across the inclined plate thus defining a lower chute plate or surface 123 which slopes downwardly and outwardly from the oblique bend line beneath edge 115 of vertical plate 109 so as to turn grain flowing down inner grain channel 113 on the upper surface of plate 119 from the inner grain channel 113 into the outer channel 111 and to effect an approximately 180° twist or rotation of the grain so as to exchange grain in widthwise direction within inner column 113. This is best illustrated in FIG. 6 and will be further described hereinafter.

As shown in FIGS. 4 and 5, outer grain channel 111 has a respective inclined plate 125 secured to its respective side plates 105, 107 at an angle comparable to the corresponding to the downwardly sloping edge 117 of vertical plate 109. As indicated at 127, there is an apex at the intersection of sloping edges 115 and 117 of vertical plate 109. Like inclined plate 119, inclined plate 125 has an oblique bend line 129 extending substantially across inclined plate 125 and defining a lower chute 131 which slopes downwardly and inwardly beneath edge 117 of vertical plate 109 so as to turn grain flowing down outer grain column 111 on the upper surface of inclined plate 125 from the outer column 111 into the inner column 113 and to effect an approximately 180° twist in the grain so as to exchange grain in widthwise direction within outer column 111. It will be noted that the undersides of inclined plates 119 and 125 define or form voids or spaces therebelow within the inner and outer grain columns 111 and 113 and that the lower chutes 123 and 131 of these inclined plates extend from the inner grain column into the outer grain column and vice a versa. In this manner, grain flowing down the upper surfaces of inclined platens 119 and 125 have a space in the opposite grain columns into which they may flow are they are turned by the oblique bend lines and their respective lower chutes 123 and 131.

Further, due to the oblique bend lines 121 and 129 of the inclined plates 119 and 125, the grain flowing downwardly on the upper surfaces of the inclined plates 119 and 125 is effectively twisted about a vertical axis passing generally through apex 127. This twisting action is shown best in FIG. 6. FIG. 7 depicts the prior art grain turner, as shown in FIGS. 2 and 3. In FIGS. 6 and 7, the thickness of grain path 11 is shown to be divided into twelve imaginary vertical columns 1–12 extending between the inner dryer wall 7 and outer dryer wall 9. As shown in FIG. 7, the grain is turned by the prior art grain turner 31 from the inner and outer regions of the grain path, but there is substantially no twisting of the grain from one vertical column to the other. However, in contrast, with the grain turner 101 of the instant invention, imaginary grain columns 1–5 (which correspond to the grain flowing within the inner grain column 113 shown in FIGS. 4 and 5) and the grain flowing in columns 6 - 10 (which corresponds to the grain flowing within outer grain column 111) are twisted about a vertical axis generally between columns 5 and 6, which axis corresponds generally to apex 129, so as to not only exchange grain between the inner and outer regions of the grain path 11, but this twisting action of the grain insures the widthwise exchange of grain within the grain path.

Further in accordance with the grain turner 101 of the present invention, a layer L (as shown in FIG. 6 to correspond to the outer imaginary columns 11 and 12) of wet (i.e., less dried) grain may be left substantially undisturbed along the inner face of outer dryer wall 9. That is, this layer L of grain is by-passed around grain turner 101. It has been found that by allowing this layer L of "wet" grain to remain proximate the outer dryer wall 9, that the amount of fines and other debris discharged to the atmosphere is substantially lessened as the grain is turned by grain turner 101. It has been further found that upon turning the grain in the grain turner such that with in drier grain from the inner reaches of the grain path exchanged with the more moist grain from the outer reaches of the grain path, the drier grain is disposed adjacent the layer L along the outer dryer wall and that this facilitates satisfactory drying of the outer layer L without having to turn the outer layer. As noted, this by-passing of the outer layer of grain is optional. For example, in larger dryers, such as tower dryers, it may be desirable to allow this outer layer to by-pass grain turner 101, but in a smaller, portable dryer, it may be desirable to turn the entire thickness of the grain path.

As shown in FIG. 4, each of the modules 103 (or a group of such modules) may be provided with an outer vertical wall 133 which is spaced inwardly from outer dryer wall 9 a predetermined distance that corresponds generally to the thickness of layer L to be by-passed around grain turner 101. For example, such vertical wall 133 may be spaced inwardly from dryer wall 9 a distance of about two inches (5.1 cm.). Outer vertical wall 133 preferably extends in heightwise direction approximately the full height of turner 101.

As shown in FIG. 4, side plates 105, 107 may optionally be provided with slits 135*a*–135*e* at predetermined locations and angles. These slots serve to locate the respective edges of vertical plate 109 and inclined plates 119 and 125 such that when the edges of these plates are inserted into their respective slits during manufacture of the grain turner modules 103, the plates are accurately positioned and held in place to facilitate welding of these plates to side plates 105 and 107.

Figure 8:
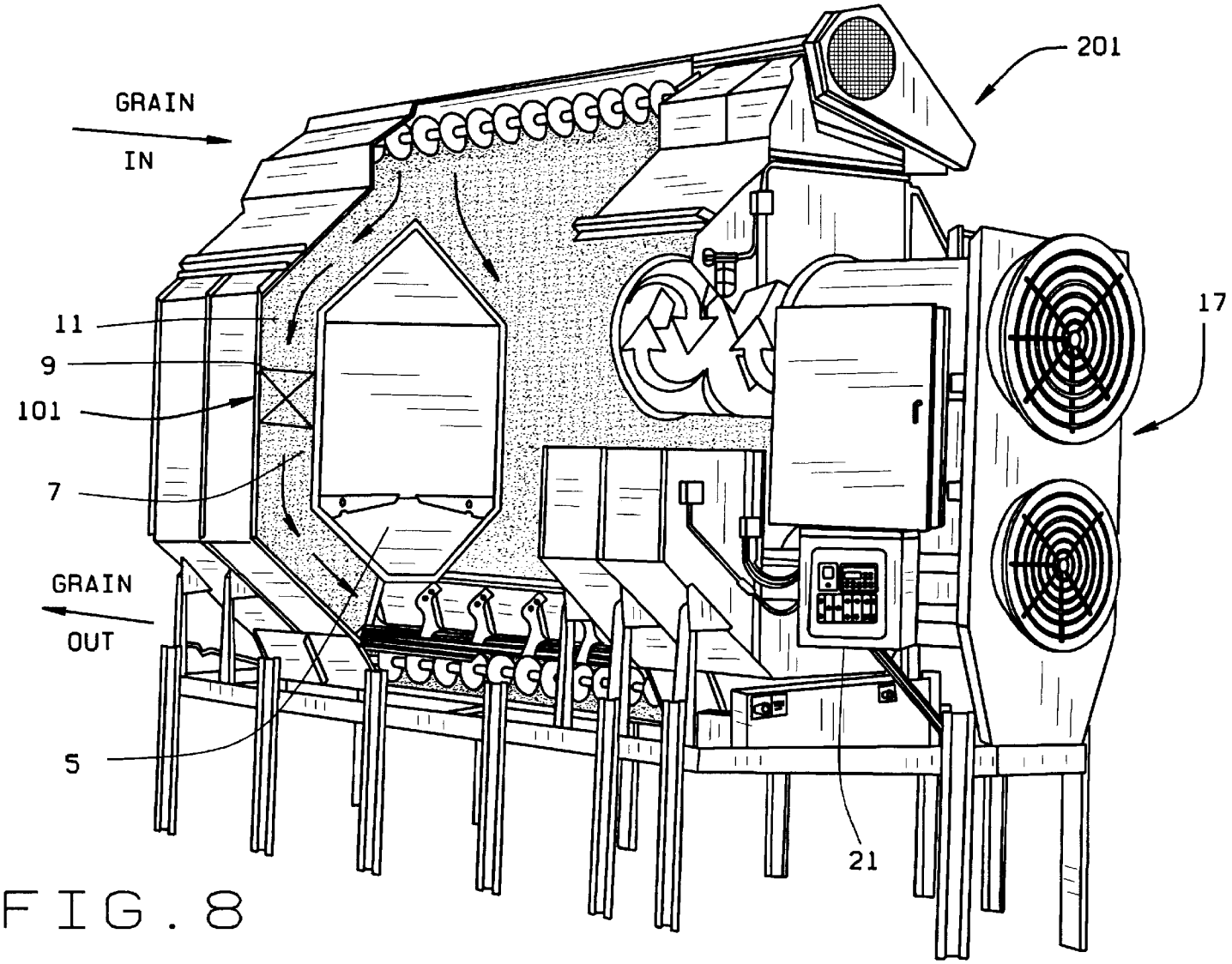
FIG. 8 is a perspective view of a so-called portable grain dryer also having a grain turner of the present invention installed in its grain drying path.

While the dryer, as described above, is a tower dryer (as shown in FIG. 1), it will be understood that the grain turner of this invention, as herein described and claimed, may be used with other types of grain dryers. For example, certain portable continuous flow grain dryers which also have spaced inner and outer porous walls with a vertical grain path therebetween may utilize the grain turner of this invention. Specifically, as shown in FIG. 8, a so-called portable grain dryer is indicated in its entirety at 201. The operation of such portable grain dryers is well known to those skilled in the art and for the sake of brevity, the construction and operation of such dryers is not fully herein described. However, in general terms, the portable dryer 201 has major components similar to tower dryer T and thus corresponding reference characters in FIG. 8 indicated corresponding components or features between the two dryers. Dryer 201 is shown to have a grain turner 101 mounted within grain path 11 for turning the grain flowing downwardly within the grain path in a manner similar to that described above in regard to tower dryer T. In fact, the only substantial difference between the grain turner 101 used in portable dryer 201 and in tower dryer T is that, due to the shorter distance of the grain path 11 in the portable dryer 201, it is preferred that vertical walls 109 and 133 of the grain turner be formed of porous sheet metal or the like so as to allow drying air to move through the grain as the grain flows through the grain turner. In other words, by providing such porous vertical walls in the grain turner, the flow of drying air is not blocked by the grain turner. The construction and operation of such portable dryers are more fully described in the co-assigned U.S. Pat. No. 5,651,193 which is herein incorporated by reference.

It can be seen that the detailed description of the preferred forms and embodiments of the invention fulfill the objects and advantages set forth above. Inasmuch as numerous modifications may be made to the preferred embodiments without departing from the spirit and scope of the invention, the scope of the invention is to be determined by the scope of the following claims.

We claim:

1. A grain turner for a grain dryer, the latter having an inner dryer wall and an outer dryer wall spaced therefrom and defining a vertically extending grain path therebetween, said grain path having a thickness corresponding generally to the space between said inner and outer dryer walls, said grain path further having a height direction extending vertically of the grain path and a width direction extending generally horizontally within said space between said inner and outer dryer walls, said grain turner being disposed within said grain path between said inner and outer dryer walls for exchanging grain from the inner portion of said grain path to the outer portion of said grain path and vice versa and for exchanging grain widthwise within said grain path, said grain turner comprising a vertical wall disposed between said inner and outer dryer walls and being generally parallel to said inner and outer dryer walls, said vertical wall thus defining an inner and an outer vertical grain channel, at least one pair inclined plates with one of said plates being on the inside of said vertical wall and with the other of said inclined plates being on the outside of said vertical wall, said one of said inclined plates being inclined downwardly in a first widthwise direction and with the other of said inclined plates being inclined downwardly in the opposite widthwise direction, the lower end of said first inclined plate extending downwardly and outwardly toward said outer dryer wall so as to direct grain flowing down the upper surface of said first inclined plate to a location within said outer grain channel substantially beneath said second inclined plate, the lower end of said second inclined plate extending downwardly and inwardly toward said inner dryer wall so as to deliver grain flowing down the upper surface of said second inclined plate to a location within said inner grain channel substantially beneath said first inclined plate so that the grain flowing down said first inclined plate is turned from the inside to the outside of said grain path and so that grain flowing down said second inclined plate is turned from the outside to the inside of said grain path and so that the grain flowing down said inclined plates is rotated about a substantially vertical axis within said grain path so as to effect the widthwise exchange of grain from one width location to another as said grain is turned.

2. A grain turner as set forth in claim 1 wherein said inclined plates have an oblique bend line for effecting said turning and twisting action of said grain as the grain flows downwardly on the upper surface of said inclined plates.

3. A grain turner as set forth in claim 1 wherein said vertical plate as a pair of inclined edges sloping downwardly and meeting at an apex with the slope of said edges being substantially similar to the slope of said inclined plates.

4. A grain turner as set forth in claim 2 wherein said vertical plate as a pair of inclined edges sloping downwardly and meeting at an apex with the slope of said edges being substantially similar to the slope of said inclined plates, and wherein said apex coincides generally with a vertical axis about which said grain is twisted as grain is exchanged from said inner grain channel to said outer grain channel and vice versa.

5. A grain turner as set forth in claim 1 further having a plurality of turning modules, each of said turning modules comprising a pair of spaced vertical walls extending from the inner wall of said dryer toward the outer wall of said dryer with said vertical wall extending in widthwise direction therebetween and with one pair of said inclined plates for each of said modules.

6. A grain turner as set forth in claim 5 wherein each of said spaced vertical walls has a plurality of slits therein for receiving respective edges of said vertical and said inclined plates thereby to located and to hold said vertical and inclined plates.

7. A grain turner as set forth in claim 1 further including means for by-passing a layer of grain adjacent the outer wall of said dryer around said grain turner such that said layer is substantially undisturbed by said grain turner.

8. A grain turner as set forth in claim 1 wherein said grain turner further has an outer vertical wall spaced inwardly from said outer dryer wall such that a layer of grain flowing downwardly within said grain path on the outside of said outer vertical wall and said outer dryer wall is by-passed around said grain turner such that grain layer is substantially undisturbed by said grain turner.

9. A grain turner as set forth in claim 1 further having means for permitting a layer of wet grain to remain proximate said outer dryer wall thereby to inhibit the discharge of fines and debris as the grain flowing downwardly within said grain path encounters said grain turner.

10. A method of turning grain in a grain path of a grain dryer as said grain flows downwardly within said grain dryer, said dryer having an inner wall and an outer wall defining said grain path, said grain dryer further having a grain turner within said grain path, wherein the method comprises:

as said grain flows downwardly within said grain path and encounters said grain turner dividing said grain path into an inner grain channel and an outer grain channel;

within a limited extent of said grain path in widthwise direction, causing said inner grain channel to flow downwardly in an inclined direction substantially widthwise;

then, causing said downwardly flowing inner grain channel to flow outwardly and to at least in part twist about a vertical axis;

within a limited extent of said grain path in widthwise direction, causing said outer grain channel to flow downwardly in an inclined direction in the opposite widthwise direction from said inner grain channel; and then, causing said downwardly flowing outer grain channel to flow inwardly and to at least in part twist about said vertical axis thereby to turn the grain in said grain path to be turned between said inner and outer grain channels and to cause said grain from said inner and outer grain channels to twist about each other and about said vertical axis.

11. The method of claim 10 further comprising by-passing a layer of grain in said grain path proximate said outer dryer wall around said grain turner such that said layer remains unturned.

12. The method of claim 10 further comprising allowing a layer of grain adjacent said outer dryer wall to remain against said outer dryer wall substantially without being turned as said grain flows downwardly past said grain turner.

* * * * *